US009589709B2

(12) United States Patent
Tanabe et al.

(10) Patent No.: US 9,589,709 B2
(45) Date of Patent: Mar. 7, 2017

(54) METHOD FOR MANUFACTURING STRING-LIKE OBJECT COVERED WITH EMBROIDERY MATERIAL

(71) Applicant: Tanabe Embroidery Co., LTD., Higashikagawa-shi, Kagawa (JP)

(72) Inventors: Tomoaki Tanabe, Higashikagawa (JP); Keisuke Hashimoto, Higashikagawa (JP); Kae Asakuni, Higashikagawa (JP)

(73) Assignee: TANABE EMBROIDERY CO., LTD., Kagawa (JP)

( * ) Notice: Subject to any disclaimer, the term of this patent is extended or adjusted under 35 U.S.C. 154(b) by 0 days.

(21) Appl. No.: 14/889,716

(22) PCT Filed: Jan. 21, 2014

(86) PCT No.: PCT/JP2014/051054
§ 371 (c)(1),
(2) Date: Nov. 6, 2015

(87) PCT Pub. No.: WO2015/111129
PCT Pub. Date: Jul. 30, 2015

(65) Prior Publication Data

US 2016/0118163 A1 Apr. 28, 2016

(51) Int. Cl.

| | |
|---|---|
| ***D05B 3/00*** | (2006.01) |
| ***H01B 13/22*** | (2006.01) |
| ***A41D 27/24*** | (2006.01) |
| ***H04R 1/10*** | (2006.01) |
| ***H01B 13/34*** | (2006.01) |

(52) U.S. Cl.
CPC ..... *H01B 13/22* (2013.01); *A41D 27/24* (2013.01); *H01B 13/34* (2013.01); *H04R 1/1033* (2013.01)

(58) Field of Classification Search
CPC .... D05C 17/00; A47G 27/0256; D05B 93/00; D05B 73/12; A41D 27/24; B60R 13/04
USPC ..... 112/475.18, 412, 413, 415, 157, 417
See application file for complete search history.

(56) References Cited

U.S. PATENT DOCUMENTS 4,981,095 A * 1/1991 Sturm ..... D04D 9/04 112/417
5,226,379 A * 7/1993 Everett ..... D05B 35/062 112/139

FOREIGN PATENT DOCUMENTS

| | | |
|---|---|---|
| JP | 2011-155623 A | 8/2011 |
| JP | 2012-20416 A | 2/2012 |
| WO | 2008/095038 A1 | 8/2008 |

OTHER PUBLICATIONS

English Translation of International Search Report of PCT/JP2014/051054.

* cited by examiner

*Primary Examiner* — Tejash Patel
(74) *Attorney, Agent, or Firm* — Muncy, Geissler, Olds & Lowe, P.C.

(57) ABSTRACT

A method for manufacturing a covered string-like object, the method comprising a placement step of placing a string-like object on a sheet-like flexible backing, a sewing step of sewing the string-like object to the backing with an embroidery material, and a separation step of separating the backing from the string-like object. According to the method for manufacturing a string-like object, a string-like object can be easily and reliably covered with an embroidery material.

9 Claims, 4 Drawing Sheets

METHOD FOR MANUFACTURING STRING-LIKE OBJECT COVERED WITH EMBROIDERY MATERIAL

TECHNICAL FIELD

The present invention relates to a method for manufacturing a covered string-like object, and more specifically, relates to a method for manufacturing a covered string-like object obtained by covering a string-like object such as an electrical cord with an embroidery material.

BACKGROUND ART

Research has been conducted on enhancing the aesthetic characteristics of electrical cords such as earphone cords, power cords, and extension cords by covering such cords with cloth, thread, or the like (for example, Patent Literatures 1 and 2). A method in which cloth, string, or the like is adhered to an electrical cord, a method in which thread, leather string, or the like is wound around or sewn to an electrical cord, and like methods are known examples of specific methods for covering electrical cords.

CITATION LIST

Patent Literature

Patent Literature 1: JP 2011-155623A
Patent Literature 2: JP 2012-20416A

SUMMARY OF INVENTION

Technical Problem

However, in the case where the target of covering is a string-like object such as an electrical cord or a power cable that is repeatedly bent during use, covering methods that utilize adhesion or winding pose durability problems. On the other hand, although methods in which thread is sewn to a string-like object can enhance the aesthetic characteristics by using an embroidery thread, there is a possibility of a needle accidentally penetrating the string-like object during sewing work. Therefore, problems such as insufficient electrical conduction resulting from damaging the conductive wire of an electrical cord are likely to occur, and such methods are thus problematic in that the sewing work is likely to be troublesome.

Accordingly, an objective of the present invention is to provide a method for manufacturing a covered string-like object, capable of easily and reliably covering the string-like object with an embroidery material.

Solution Problem

The foregoing object of the present invention is achieved by a method for manufacturing a covered string-like object, comprising:

a placement step of placing a string-like object on a sheet-like flexible backing;

a sewing step of sewing the string-like object to the backing with an embroidery material; and a separation step of separating the backing from the string-like object.

In this method for manufacturing a covered string-like object, it is preferable that the backing is attached to one surface of a template having a cut-out hole formed in accordance with a shape of the string-like object, and it is preferable that the placement step comprises placing the string-like object on the backing via the cut-out hole.

It is preferable that the embroidery material comprises an upper thread and a lower thread, and it is preferable that the sewing step comprises performing zigzag stitching while entwining the upper thread and the lower thread on both sides of the string-like object that has been linearly placed.

The placement step may comprise placing a decoration on the backing so as to be adjacent to the string-like object; the sewing step may comprise sewing the decoration to the backing during a course of sewing the string-like object to the backing in a lengthwise direction; and the separation step may comprise separating the string-like object and the decoration from the backing.

It is preferable that the backing is composed of an easily tearable stretched film.

Advantageous Effects of Invention

The present invention can provide a method for manufacturing a covered string-like object, capable of easily and reliably covering the string-like object with an embroidery material.

DESCRIPTION OF EMBODIMENTS

Figure 1:
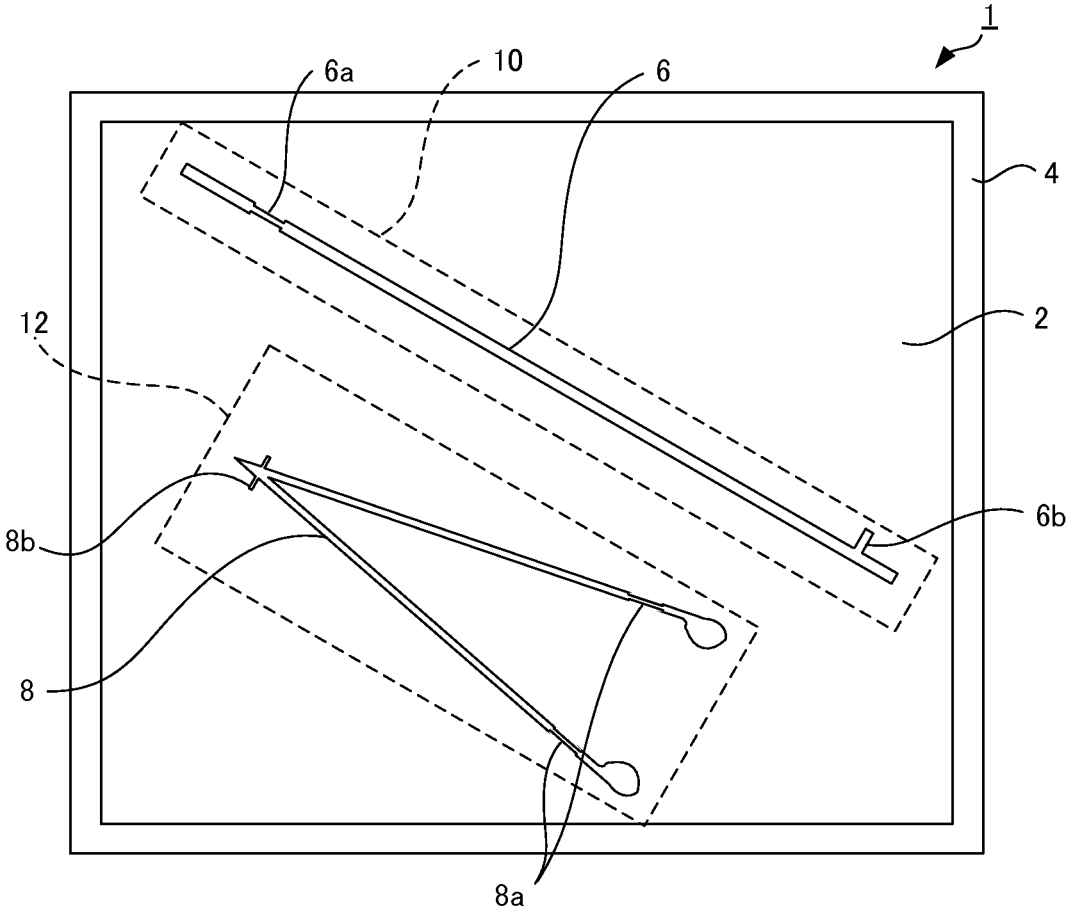
FIG. 1 is a plan view of a template used for a method for manufacturing a covered string-like object according to one embodiment of the present invention.

Below, embodiments of the present invention will now be described with reference to the appended drawings. FIG. 1 is a plan view of a template used for a method for manufacturing a covered string-like object according to one embodiment of the present invention. A template 1 shown in FIG. 1 is used for an earphone cord as a string-like object to be covered. The template 1 is configured such that a plate body 2 having a rectangular shape is provided within a frame 4, and the plate body 2 has two cut-out holes 6 and 8 formed in accordance with the shape of the string-like object to be covered. As indicated by the dashed lines in FIG. 1, the cut-out holes 6 and 8 are respectively covered with backings 10 and 12 attached to one surface (the back-surface side) of the plate body 2 using an easily removable adhesive or the like, and the string-like object (not shown) can be placed on the backings 10 and 12 via the cut-out holes 6 and 8.

It is preferable that the plate body 2 has such a rigidity that the plate body 2 does not deform due to the attachment of the backings 10 and 12. The plate body 2 can be formed from, for example, cardboard, a synthetic-resin plate, or a metal plate. In accordance with the overall shape of the earphone to be covered, the cut-out holes 6 and 8 are each formed so as to be able to accommodate roughly half of the earphone cord. The cut-out hole 6 can accommodate roughly a plug-side half of the earphone cord in a straightened state. The cut-out hole 8 can accommodate the bifurcated portions of the earphone cord both in a straightened state.

The cut-out hole 6 comprises a narrow holding part 6*a* and a slot-like insertion part 6*b* on the respective sides in the lengthwise direction. The distal part of the earphone cord is held by the holding part 6*a*, and, on the other hand, an insert (not shown) is inserted into the insertion part 6*b* to latch the mid part of the earphone cord, and it is thus possible to fix the earphone cord within the cut-out hole 6. As with the cut-out hole 6, the cut-out hole 8 also comprises holding parts 8*a* and an insertion part 8*b*. As long as the earphone cord can be reliably fixed within the cut-out holes 6 and 8, fixing means other than the holding parts 6*a* and 6*b* and the insertion parts 8*a* and 8*b* may be used.

The backings 10 and 12 are sheet-like components that a sewing-machine needle can penetrate, and it is preferable that the backings 10 and 12 are flexible so as to conform to the earphone cord during sewing. Examples of the material of the backings 10 and 12 include synthetic resin film, metal foil, thin paper, and the like. Since the backings 10 and 12 are eventually separated from the earphone cord, it is preferable that the backings 10 and 12 have excellent tearability, and, for example, a stretched polyethylene film or the like that is easily torn in the direction of stretch can be suitably used.

Figure 2A:
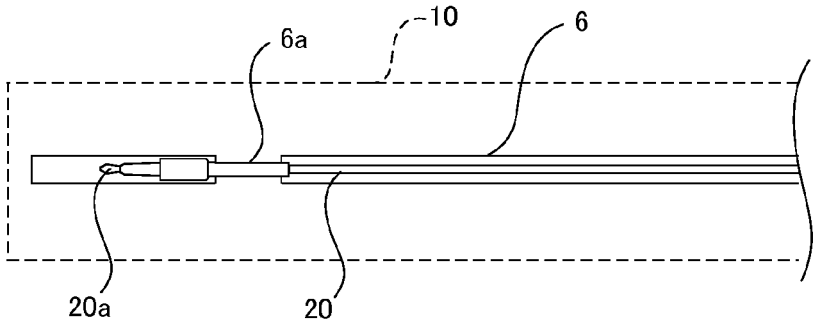
FIGS. 2(*a*) to 2(*c*) are diagrams showing principal steps of one example of a method for manufacturing a covered string-like object in which the template shown in FIG. 1 is used.
Figure 2B:
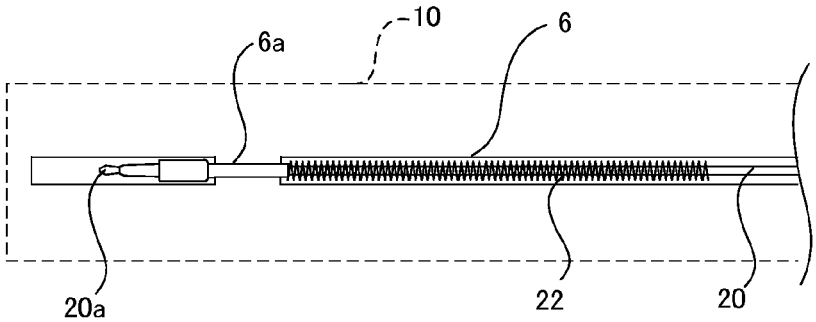
Figure 2C:
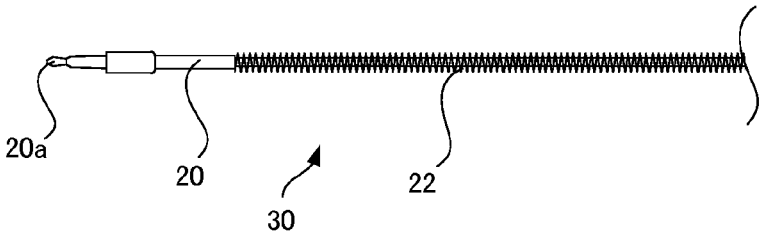

Next, a method for manufacturing a covered string-like object using the above-described template 1 will now be described with reference to FIG. 2. FIG. 2 shows partially enlarged views of the cut-out hole 6 of the template shown in FIG. 1. First, as shown in FIG. 2(*a*), the plug 20*a* side of the earphone cord 20 in a straightened state is accommodated inside the cut-out hole 6, the proximal part of the plug 20*a* is held by the holding part 6*a*, and also the side of the earphone cord 20 at the center is fixed at the insertion part 8*b* shown in FIG. 1. In this way, the earphone cord 20 is positioned on the backing 10 via the cut-out hole 6.

Figure 3:
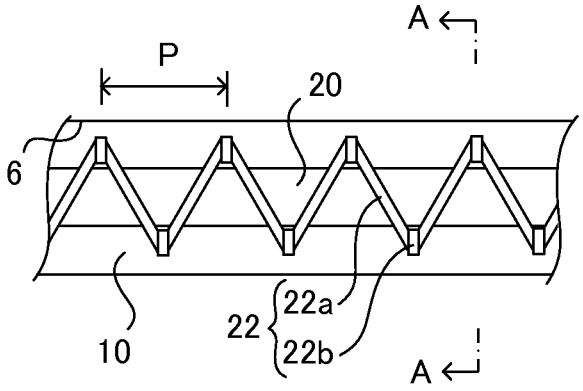
FIG. 3 is an enlarged view of principal parts, showing a state during the process of manufacturing a covered string-like object.

Subsequently, this template 1 is placed on an automatic sewing machine (not shown), and as shown in FIG. 2(*b*), a section of the earphone cord 20 from the plug 20*a* side to near the center is sewn to the backing 10 with a sewing material 22. As shown in the enlarged view of FIG. 3, the sewing material 22 is composed of an upper thread 22*a* and a lower thread 22*b*, and a sewing-machine needle is caused to penetrate the backing 10 on both sides of the earphone cord 20 to entwine the upper thread 22*a* and the lower thread 22*b* by way of zigzag lockstitching, and thus the upper thread 22*a* is disposed in a zigzag manner so as to cover the earphone cord 20 on the front-surface side of the backing 10. On the back-surface side of the backing 10, the lower thread 22*b* is disposed in a zigzag manner. A pitch p of the zigzag pattern of the upper thread 22*a* is emphasized in FIG. 3 so as to appear large, but, practically, it is preferable that the upper thread 22*a* is sewn at such a small pitch p that the earphone cord 20 is not exposed. It is also possible to entwine the upper thread 22*a* and the lower thread 22*b* in such a way that one thread forms a zigzag pattern, and the other thread linearly extends along the earphone cord 20.

Figure 4A:
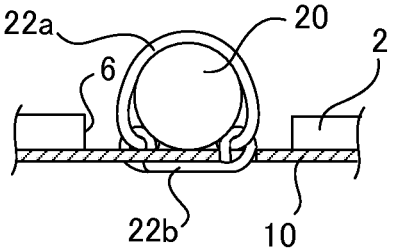
FIG. 4(*a*) is a cross-sectional view showing a state during the process of manufacturing a covered string-like object, and FIG. 4(*b*) is a cross-sectional view of a manufactured covered string-like object.
Figure 4B:
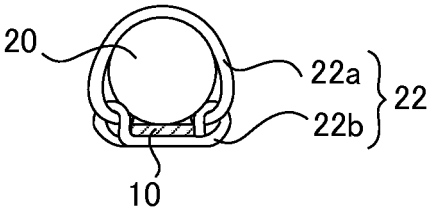

As shown in FIG. 4(*a*), the place where the upper thread 22*a* and the lower thread 22*b* are entwined may be above (on the front-surface side of) the backing 10, and, also, it may be in the interior of the backing 10 or below (on the back-surface side of) the backing 10 as well. The thread tension can be suitably adjusted. An embroidery thread can be suitably used as the embroidery material 22, thus making it possible to enhance the aesthetic characteristics by taking advantage of its color, luster, etc. The embroidery material 22 may be a string-like or belt-like embroidery material other than a thread-like material. The embroidery material 22 may be intended primarily for textural, anti-allergic, or like purposes other than aesthetic purposes.

After about half of the earphone cord 20 is sewn to the backing 10 with the embroidery material 22 in this way, the rest of the earphone cord 20 is sewn to the backing 10 with the embroidery material 22 in the same manner as above by using the cut-out hole 8 shown in FIG. 1. In this way, substantially all the earphone cord 20 can be sewn to the backing 10.

Thereafter, the earphone cord 20 is removed from the template 1 to separate the backing 10 from the earphone cord 20 as shown in FIG. 4(*b*), and, thereby, the entire outer circumference of the earphone cord 20 is covered with the upper thread 22*a* and the lower thread 22*b*, and, as shown in FIG. 2(*c*), it is thus possible to obtain the covered string-like object 30 in which the earphone cord 20 is covered with the embroidery material 22. After the backing 10 is separated from the earphone cord 20, there may be a slight remainder of the backing 10 between the earphone cord 20 and the embroidery material 22 (see FIG. 4(*b*)). Forming the zigzag pattern of the embroidery material 22 at a small pitch makes it possible to prevent the remaining backing 10 from being exposed to the outside and adversely affecting the appearance. Thereafter, the backing 10 (12) remaining on the template 1 is removed, then a new backing 10 (12) is attached, and it is thus possible to used the template 1 again.

As described above, according to the method for manufacturing a covered string-like object of the present embodiment, the earphone cord 20 is sewn to the backings 10 and 12 with the embroidery material 22, and then the backings 10 and 12 are separated from the earphone cord 20. It is therefore possible to easily and reliably cover the earphone cord 20 with the embroidery material 22 without damaging the earphone cord 20 with a sewing-machine needle or the like, and thus possible to obtain the covered string-like object 30 that has good durability. Moreover, the use of the template 1 on one surface of which the backings 10 and 12 have been attached makes it possible to more easily manufacture the covered string-like object 30.

One embodiment of the present invention has been described in detail above, but the specific aspects of the present invention are not limited to the above embodiment. For example, the above embodiment has been described using an earphone cord as an example of a target to be covered with an embroidery material, but other string-like objects may be used as well, such as power cords, extension cords, and like electrical cords, and cables.

Figure 5:
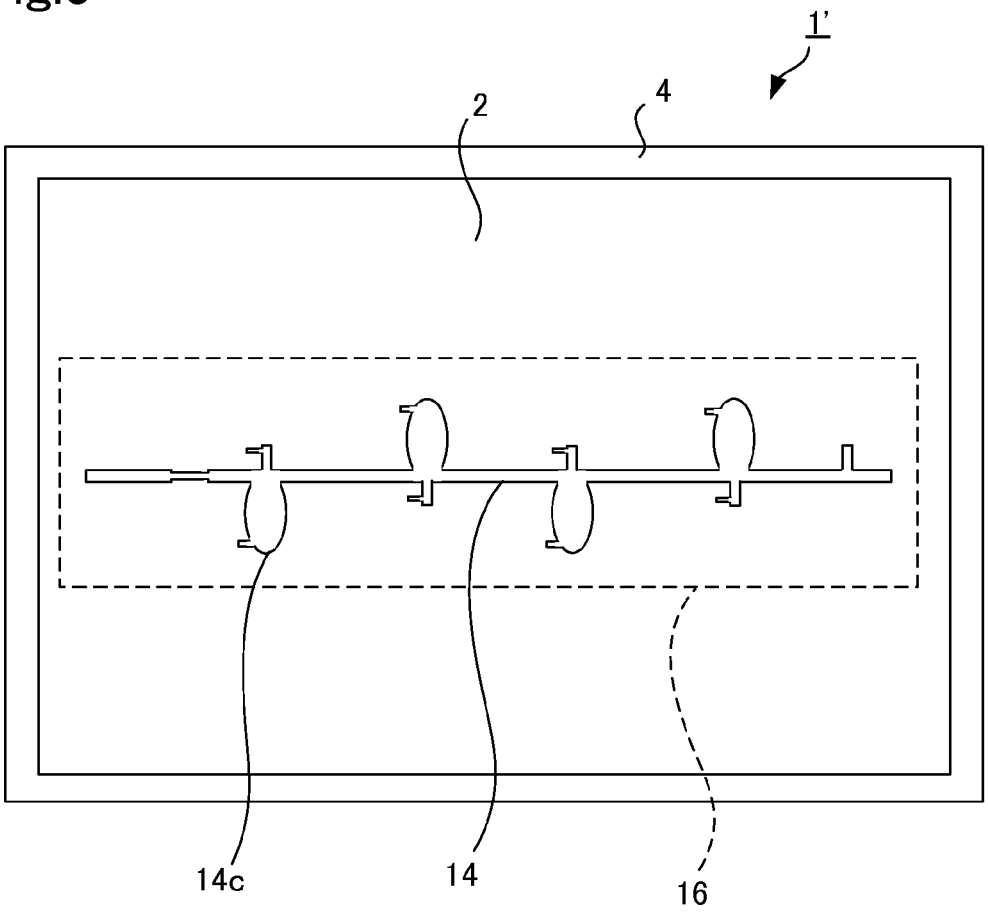
FIG. 5 is a plan view of a template used for a method for producing a covered string-like object according to another embodiment of the present invention.
Figure 6:
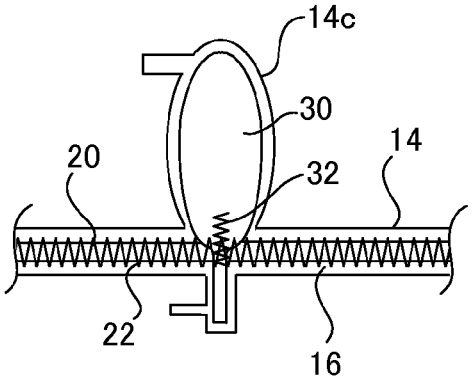
FIG. 6 is an enlarged view of principal parts, showing one example of a method for producing a covered string-like object in which the template shown in FIG. 5 is used.

Moreover, as shown in FIG. 5, one or more decorative parts 14*c* may be formed by making slots that are in communication with a linear cut-out hole 14 formed in a template 1', such that a backing 16 is attached so as to cover the cut-out hole 14 and the decorative parts 14*c*. As shown in FIG. 6, with this template 1', the string-like object 20 such as an earphone cord is placed in the cut-out hole 14, a decoration 30 (such as a leaf or a flower of a plant) is placed in the decorative parts 14*c*, and the decoration 30 can be sewn to the backing 10 with an embroidery material 32 during the course of sewing the string-like object 20 to the backing 10 with the embroidery material 22 in the lengthwise direction. The embroidery materials 22 and 32 may be the same or may be different. Thereafter, the backing 10 is separated from the string-like object 20 and the decoration 30, and it is thus possible to obtain a covered string-like object having enhanced aesthetic characteristics. In FIG. 5, the same components as in FIG. 1 are given the same reference numbers.

REFERENCE SIGNS LIST

1 Template
2 Plate body
4 Frame
6, 8 Cut-out holes
10, 12 Backings
20 Earphone cord (String-like object)

The invention claimed is:

1. A method for manufacturing a string-like object covered with an embroidery material, the method, comprising:

a placement step of placing the string-like object on a backing that is in a sheet shape and of a flexible material, the string-like object being defined to be placed in a longitudinal direction;

a sewing step of sewing the string-like object to the backing with the embroidery material such that stitching holes, which are created by the zigzag stitching, form two stitching lines that are aligned on the backing in the longitudinal direction intervening the string-like object, wherein an intervening section of the backing that intervenes between the two stitching lines in a width direction perpendicular to the longitudinal direction is sewed together with the string-like object; and a separation step of separating the backing from the string-like object by tearing the backing along the two stitching lines so that a remaining section of the backing, which does not include the intervening section, separates from the string-like object.

2. The method for manufacturing the string-like object according to claim 1, wherein the backing is attached to one surface of a template having a cut-out hole formed in accordance with a shape of the string-like object; and the placement step comprises placing the string-like object on the backing via the cut-out hole.

3. The method for manufacturing the string-like object according to claim 1, wherein the embroidery material comprises an upper thread and a lower thread; and the sewing step comprises performing zigzag stitching while entwining the upper thread and the lower thread on both sides of the string-like object that has been linearly placed.

4. The method for manufacturing the string-like object according to claim 1, wherein the placement step comprises placing a decoration on the backing so as to be adjacent to the string-like object;

the sewing step comprises sewing the decoration to the backing during a course of sewing the string-like object to the backing in a lengthwise direction; and the separation step comprises separating the string-like object and the decoration from the backing.

5. The method for manufacturing the string-like object according to claim 1, wherein the backing is composed of an easily tearable stretched film.

6. The method for manufacturing the string-like object according to claim 1, wherein in the sewing step, the embroidery material covers the string-like object so that the string-like object is barely seen from an outside.

7. The method for manufacturing the string-like object according to claim 1, wherein in the sewing step, when defining two sides of the string-like object with respect to an up-down direction, which is perpendicular to the longitudinal and width directions, an upper side of the string-like object is in contact with the embroidery material, and a lower side of the string-like object is placed on the intervening section and not in contact with the embroidery material.

8. The method for manufacturing the string-like object according to claim 3, wherein a pitch (P) of the upper thread, which is determined by two adjacent stitching holes in the longitudinal direction, is so small that the string-like object, which is covered by the upper thread, is barely seen over the upper thread.

9. The method for manufacturing the string-like object according to claim 3, wherein in the sewing step, the upper thread is in contact with the string-like object, and the lower thread is not in contact with the string-like object but in contact with the intervening section of the backing.

* * * * *